US009682572B2

(12) United States Patent
Sakano et al.

(10) Patent No.: US 9,682,572 B2
(45) Date of Patent: Jun. 20, 2017

(54) TAPE PRINTING DEVICE AND TAPE PRINTING SYSTEM

(71) Applicant: Seiko Epson Corporation, Tokyo (JP)

(72) Inventors: Hideki Sakano, Matsumoto (JP); Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/123,047

(22) PCT Filed: Mar. 19, 2015

(86) PCT No.: PCT/JP2015/001548

§ 371 (c)(1),
(2) Date: Sep. 1, 2016

(87) PCT Pub. No.: WO2015/146094

PCT Pub. Date: Oct. 1, 2015

(65) Prior Publication Data

US 2017/0072704 A1 Mar. 16, 2017

(30) Foreign Application Priority Data

Mar. 24, 2014 (JP) ..... 2014-060916
Aug. 1, 2014 (JP) ..... 2014-157992

(51) Int. Cl.
*B41J 3/407* (2006.01)
*B41J 15/04* (2006.01)
*B41J 32/00* (2006.01)

(52) U.S. Cl.
CPC ..... *B41J 3/4075* (2013.01); *B41J 15/044* (2013.01)

(58) Field of Classification Search
CPC ..... B41J 17/32; B41J 3/4075; B41J 15/044; B41J 32/00
See application file for complete search history.

(56) References Cited

U.S. PATENT DOCUMENTS 5,595,447 A * 1/1997 Takayama ..... B26D 1/305 400/231
6,007,263 A 12/1999 Imai et al.
(Continued)

FOREIGN PATENT DOCUMENTS

JP 62-042869 A 2/1987
JP 4-62566 A 2/1992
(Continued)

OTHER PUBLICATIONS

International Search Report, International Application No. PCT/JP2015/001548, Apr. 21, 2015.

*Primary Examiner* — Huan Tran
(74) *Attorney, Agent, or Firm* — ALG Intellectual Property, LLC

(57) ABSTRACT

A tape printing device in which the closing of an open/close cover and the presence/absence of a tape cartridge can be detected simultaneously is provided. The tape printing device includes a cartridge loading section in which a tape cartridge is loaded in an unloadable manner; an open/close cover which opens/closes the cartridge loading section; a cover detection section which is provided in the cartridge loading section and detects closing of the open/close cover; and a protrusion to be detected which is provided on the open/close cover, corresponding to the cover detection section. The protrusion to be detected displaces a displacement portion of the tape cartridge loaded in the cartridge loading section, with the closing of the open/close cover. The cover detection section is actuated for detection, with the displacement of the displacement portion.

8 Claims, 12 Drawing Sheets

(56) References Cited

U.S. PATENT DOCUMENTS

| | | | | |
|---|---|---|---|---|
| 9,579,903 | B2 * | 2/2017 | Sodeyama | B41J 2/325 |
| 2015/0283835 | A1 * | 10/2015 | Sakano | B41J 3/4075<br>347/214 |
| 2016/0368290 | A1 * | 12/2016 | Sakano | B41J 17/36 |
| 2016/0368294 | A1 * | 12/2016 | Sakano | B41J 17/36 |
| 2017/0036464 | A1 * | 2/2017 | Sakano | B41J 15/044 |

FOREIGN PATENT DOCUMENTS

| | | | |
|---|---|---|---|
| JP | 7-214828 | A | 8/1995 |
| JP | 10-006579 | A | 1/1998 |
| JP | 11-212428 | A | 8/1999 |
| JP | 2001-233057 | A | 8/2001 |
| JP | 2002-137475 | A | 5/2002 |
| JP | 2002-178572 | A | 6/2002 |
| JP | 3629823 | B | 3/2005 |

* cited by examiner

TAPE PRINTING DEVICE AND TAPE PRINTING SYSTEM

CROSS-REFERENCE TO RELATED APPLICATIONS

This application is the U.S. National Phase under 35 U.S.C. §371 of International Application No. PCT/JP2015/001548 filed on Mar. 19, 2015, which in turn claims the benefit of Japanese Application No. 2014-060916 filed on Mar. 24, 2014, and Japanese Application No. 2014-157992 filed on Aug. 1, 2014, the disclosures of which are expressly incorporated by reference herein.

TECHNICAL FIELD

The present invention relates to a tape printing device and a tape printing system in which a cartridge loading section where a tape cartridge is loaded has an open/close cover.

BACKGROUND ART

As a tape printing device of this type, a printer in which a loading section where a tape housing cassette (tape cartridge) is loaded is provided with a cassette cover (open/close cover) for opening/closing the loading section is known (see JP-A-7-214828).

In the tape housing cassette, three protrusions corresponding to a tape width sensor of the printer are provided. Meanwhile, in the printer, the loading section for the tape housing cassette is provided with a tape width sensor made up of a photointerrupter to detect each of the three protrusions. The tape width sensor detects the tape width of a print tape installed in the tape housing cassette, by detecting the presence/absence of each of the three protrusions. Also, in the printer, a small mechanical switch for detecting the opening/closing of the cassette cover is provided at a position off the loading section.

SUMMARY

In such a printer (tape printing device) according to the related art, since the tape housing cassette (tape cartridge) loaded in the loading section becomes an obstacle, the mechanical switch for detecting the opening/closing of the cassette cover (open/close cover) is provided at a position off the loading section. Therefore, there is a problem that the position of installation of the mechanical switch is restricted if the cassette cover is large. Also, in the detection by the tape width sensor, the tape width of the print tape and the loading of the tape housing cassette (tape cartridge) can be detected simultaneously via the three protrusions. However, with a tape housing cassette which does not have three protrusions, the state where the tape housing cassette is not loaded is detected as well. Therefore, there is a problem that a tape housing cassette which does not have three protrusions cannot be treated as a tape width detection element.

An object of the invention is to provide a tape printing device and a tape printing system in which the closing of the open/close cover and the presence/absence of a tape cartridge can be detected simultaneously.

A tape printing device according to the invention includes: a cartridge loading section in which a tape cartridge is loaded in an unloadable manner; an open/close cover which opens/closes the cartridge loading section; a detection section which is provided in the cartridge loading section and detects closing of the open/close cover; and a section to be detected which is provided on the open/close cover, corresponding to the detection section. The section to be detected displaces a displacement portion of the tape cartridge loaded in the cartridge loading section, with the closing of the open/close cover. The detection section is actuated for detection, with the displacement of the displacement portion.

According to this configuration, when the open/close cover is closed, the section to be detected provided on the open/close cover displaces the displacement portion, and with this displacement of the displacement portion, the detection section is actuated for detection. That is, the section to be detected on the open/close cover actuates the detection section for detection, via the displacement portion of the tape cartridge. Therefore, in the detection of the closing of the open/close cover by the detection section, the presence of the tape cartridge is detected. Thus, the closing of the open/close cover and the presence/absence of the tape cartridge can be detected simultaneously.

In this case, it is preferable that the section to be detected has an element to be detected which is formed in a protruding manner integrally on a back side of the open/close cover and which displaces the displacement portion, and that the element to be detected is formed in a protruding manner in a columnar shape with a "T"-shaped cross section.

According to this configuration, the element to be detected can be easily formed with the open/close cover by molding or the like. Also, since the element to be detected is formed with a "T"-shaped cross section, the element to be detected can be molded properly and the element to be detected can be provided with proper strength.

Meanwhile, it is preferable that the detection section includes a rod-like detector operated by the displacement of the displacement portion, and a detection section main body actuated for detection by the operated detector.

According to this configuration, the detection section can be securely actuated with respect to the displacement of the displacement portion, and the part exposed into the cartridge loading section can be minimized. Also, it is preferable that a switch having a push-pull operation function is used as the detection section.

In this case, it is preferable that the displacement portion is arranged inside a cartridge case of the tape cartridge, that a first receiving opening for receiving the element to be detected and a second receiving opening for receiving the detector are formed in the cartridge case, that the element to be detected displaces the displacement portion via the first receiving opening, and that the detector is operated by the displacement portion via the second receiving opening.

According to this configuration, the section to be detected (element to be detected) and the detection section (detector) can be arranged within the outline of the tape cartridge as viewed from the loading/unloading direction. Therefore, the open/close cover need not be large for providing the section to be detected, and the open/close cover can be formed compactly.

In this case, it is preferable that the element to be detected is fitted in the first receiving opening, with the closing of the open/close cover.

According to this configuration, by the element to be detected, the cartridge case can be positioned via the first receiving opening. That is, the tape cartridge can be pressed in a positioned state to the cartridge loading section. Therefore, the tape cartridge can be accurately positioned in the cartridge loading section and the print quality can be stabilized.

In this case, it is preferable that a position where the element to be detected abuts against the displacement portion and a position where the detector abuts against the displacement portion are shifted from each other, as viewed from a loading/unloading direction of the tape cartridge.

According to this configuration, the degree of freedom in the positions of arrangement of the section to be detected (element to be detected) and the detection section (detector) can be increased. That is, even when a layout to coaxially arrange the element to be detected and the detector is difficult, the detection section can be properly actuated with the closing of the open/close cover.

Moreover, it is preferable that the displacement portion is formed in an elastically deformable manner, and that the element to be detected elastically deforms the displacement portion with the closing of the open/close cover.

According to this configuration, as the displacement portion is elastically deformed by the element to be detected, the tape cartridge is elastically pressed by the element to be detected. Thus, not only the closing of the open/close cover and the presence/absence of the tape cartridge can be simultaneously detected, but also the misalignment of the tape cartridge can be restrained. That is, the misalignment of the tape cartridge in the cartridge loading section can be restrained and the print quality can be stabilized.

A tape printing system according to the invention includes: the above tape printing device; and a tape cartridge loaded in the cartridge loading section in an unloadable manner.

According to this configuration, since the closing of the open/close cover and the presence/absence of the tape cartridge can be simultaneously detected, the device configuration can be simplified.

DESCRIPTION OF EXEMPLARY EMBODIMENTS

Hereinafter, a tape printing device and a tape printing system according to an embodiment of the invention will be described, referring to the accompanying drawings. This tape printing device is configured to perform printing while reeling off a print tape and an ink ribbon from a tape cartridge loaded therein, and cut a printed part of the print tape, thus preparing a label (tape piece). Also, the tape printing system is made up of this tape printing device and a tape cartridge loaded and used therein.

[Outline of Tape Printing Device]

Figure 1:
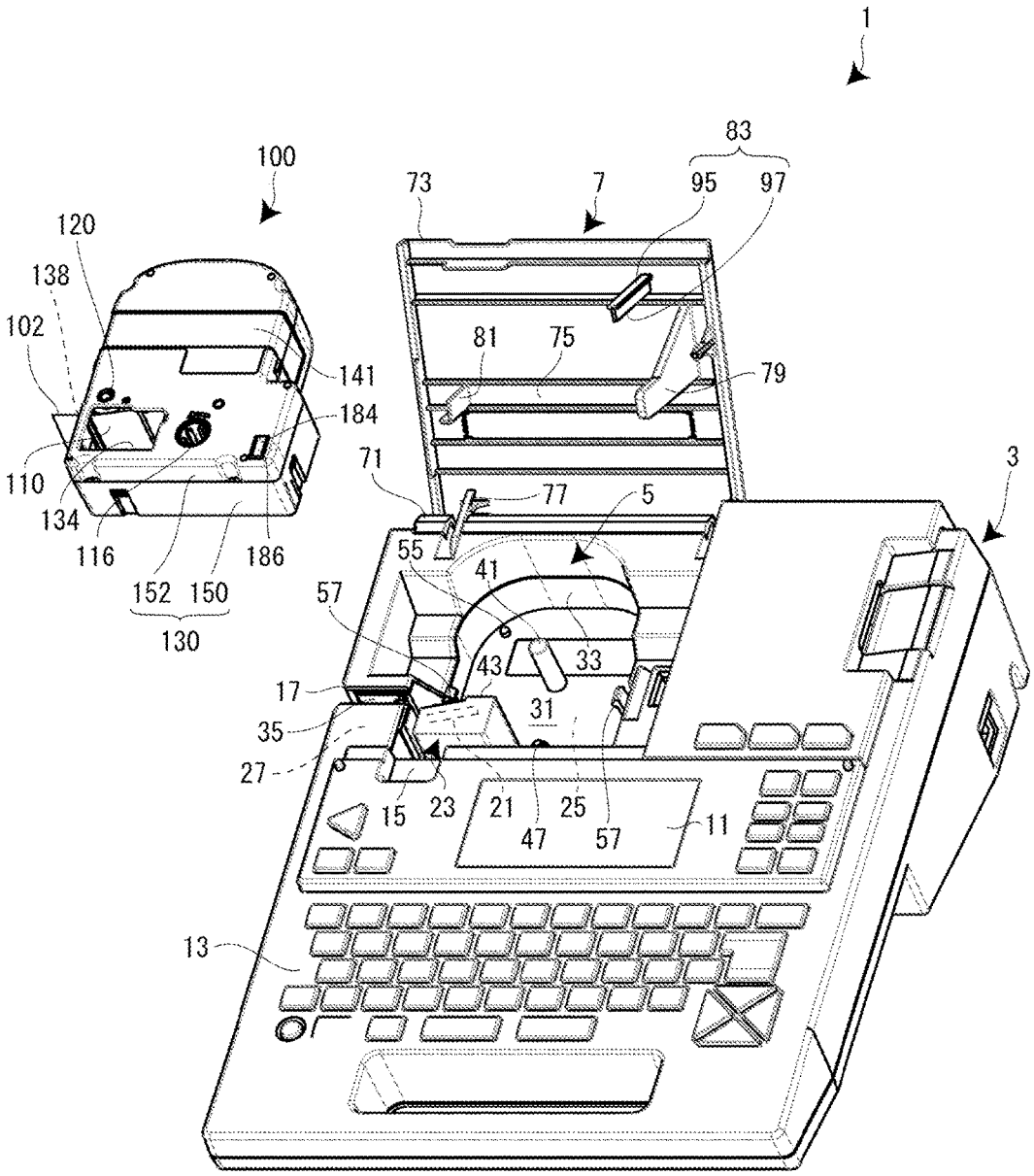
FIG. 1 is an external perspective view of a tape printing device (in an open-cover state) and a tape cartridge that form a tape printing system according to an embodiment.

FIG. 1 is an external perspective view of a tape printing device and a tape cartridge loaded therein, forming a tape printing system. As shown in FIG. 1, a tape printing device 1 includes a device case 3 forming an outer shell, a cartridge loading section 5 in which a tape cartridge 100 is loaded in an unloadable manner, and an open/close cover 7 which opens and closes the cartridge loading section 5. On a top surface of the device case 3, the cartridge loading section 5 is provided on the rear side, a display 11 is provided in the center, and a keyboard 13 is provided on the forward side. A dent portion 15 to hook a finger is provided near the open/close cover 7. The open/close cover 7 is opened by having a finger hooked on this dent portion 15 and lifting up the open/close cover 7. Then, on a lateral side (left side) of the device case 3, a vertically long tape discharge port 17 through which a print tape 102 is discharged is provided.

Also, the tape printing device 1 includes a print mechanism section 23 having a print head 21 provided upright in the cartridge loading section 5, a tape feed mechanism section 25 provided inside the space on the back of the cartridge loading section 5, and a tape cutting mechanism section 27 provided inside near the tape discharge port 17. The user inputs print information from the keyboard 13, confirms the print information on the display 11, and subsequently executes printing by a key operation. As a print command is given, the tape feed mechanism section 25 is driven, thus causing the print tape 102 and an ink ribbon 110 to travel in parallel, and on this, printing based on thermal transfer is carried out by the print mechanism section 23. By this print feed, the print tape 102 is discharged from the tape discharge port 17. When the printing is completed, the tape cutting mechanism section 27 is driven, thus cutting the printed part of the print tape 102.

[Outline of Tape Cartridge]

As shown in FIGS. 1, 2A, 2B, 5A and 5B, the tape cartridge 100 includes a tape roll 106 having the print tape 102 wound on a tape core 104, and a ribbon roll 114 having the ink ribbon 110 wound on a reel-off core 112. Also, the tape cartridge 100 includes a take-up core 116 which takes up the ink ribbon 110 after use, and a platen roller 120 (platen) against which the print head 21 abuts and which feeds the print tape 102 and the ink ribbon 110. Moreover, the tape cartridge 100 has a cartridge case 130 accommodating the tape roll 106, the ribbon roll 114, the take-up core 116 and the platen roller 120. In this way, the tape cartridge 100 in this embodiment has a so-called shell structure in which the outer shell is covered by the cartridge case 130.

Also, in the tape cartridge 100, an insertion opening 134 in which the print head 21 is inserted when the tape cartridge 100 is loaded in the tape printing device 1 is formed in the cartridge case 130. Also, the tape cartridge 100 has a tape outlet port 138 through which the print tape 102 is sent out. Also, as will be described in detail later, the tape roll 106 is rotatably supported on a cylindrical core shaft 192 provided in a protruding manner on the inside of the cartridge case 130.

As the platen roller 120 and the take-up core 116 are driven by the above tape feed mechanism section 25, the print tape 102 is reeled off from the tape core 104, and the ink ribbon 110 is reeled off from the reel-off core 112. The print tape 102 and the ink ribbon 110, thus reeled off, travel in parallel at the part of the platen roller 120 and are used for printing by the print head 21. The reel-off end (printed part) of the print tape 102 where printing has been done is sent out toward the tape discharge port 17 from the tape outlet port 138. Meanwhile, the ink ribbon 110 travels around a circumferential wall part of the insertion opening 134 and is taken up on the take-up core 116. As the tape cartridge 100, a plurality of types with different thicknesses is prepared according to the tape widths of the print tape 102.

[Details of Tape Printing Device]

Figure 3:
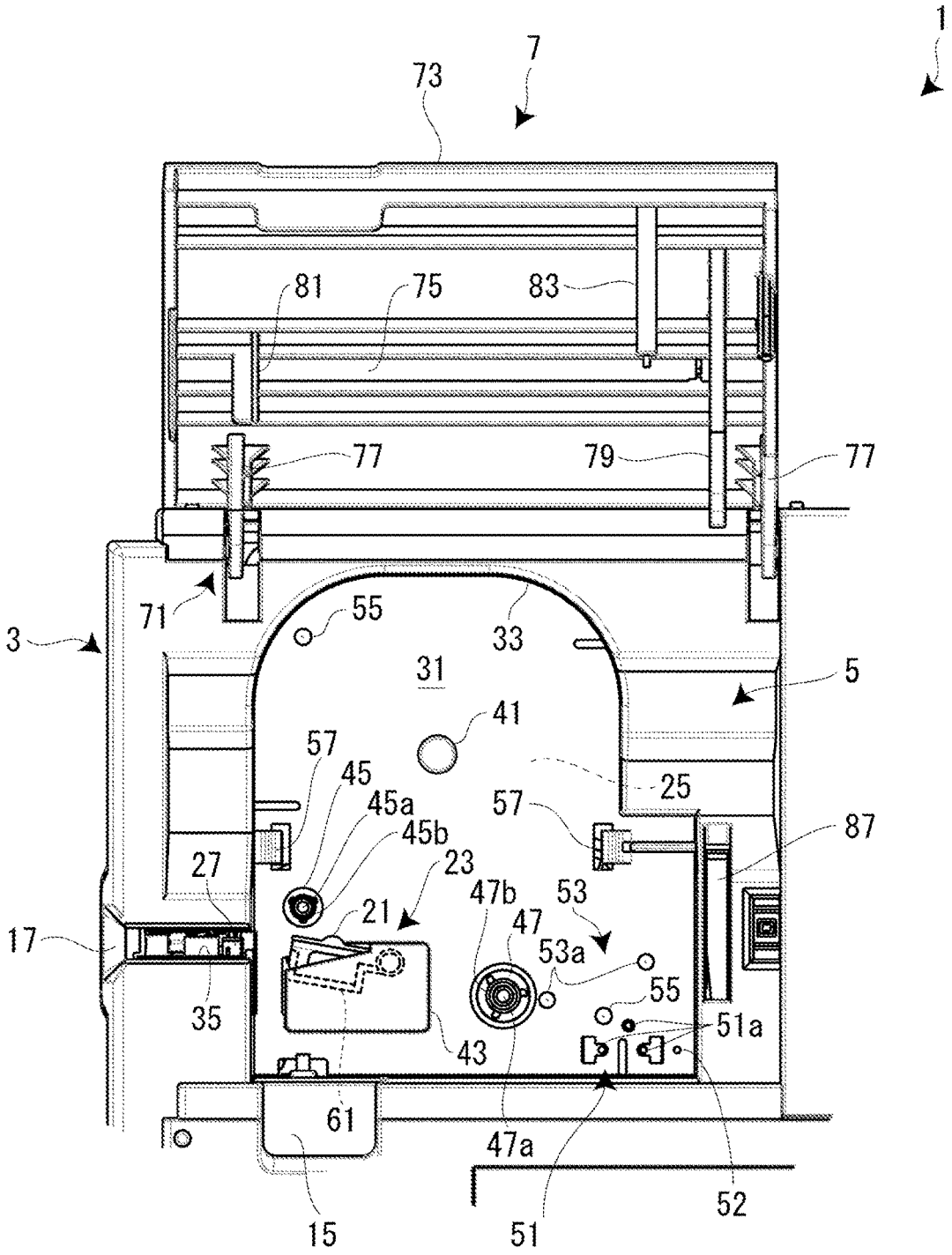
FIG. 3 is a plan view of a cartridge loading section.

As shown in FIG. 1 and FIG. 3, the cartridge loading section 5 is formed in a planar shape complimentary to the planar shape of the tape cartridge 100 and is formed as a dent having a depth corresponding to the tape cartridge 100 with a maximum thickness, of the plurality of types of tape cartridges 100. In this case, a loading base 31 forming a bottom plate part of the cartridge loading section 5, and a side plate part 33 are integrally formed (molded) of a resin or the like. A slit-like tape discharge path 35 is formed between the cartridge loading section 5 and the above tape discharge port 17, and the above tape cutting mechanism section 27 is arranged inside this part.

On the loading base 31 of the cartridge loading section 5, a positioning protrusion 41 with which the core shaft 192 of the tape cartridge 100 is fitted and positioned when the tape cartridge 100 is loaded, the print head 21 covered by a head cover 43, a platen drive shaft 45 which rotationally drives the platen roller 120, and a take-up drive shaft 47 which rotationally drives the take-up core 116 are provided upright. Also, on the loading base 31, a tape detection section 51 which detects the type (attribute information) of the print tape 102, a cover detection section 52 which detects the closing of the open/close cover 7, and a core release section 53 which cancels the rotation stopper of the reel-off core 112 and the take-up core 116 are provided near the take-up drive shaft 47 (see FIG. 3).

Moreover, a pair of small protrusions 55 is provided at diagonal positions on the loading base 31, and in addition, a pair of hook pieces 57 which hooks a middle part of the loaded tape cartridge 100 is provided. Then, in the space on the back of the loading base 31, the above tape feed mechanism section including a motor and a gear train (neither being illustrated) or the like for rotating the platen drive shaft 45 and the take-up drive shaft 47 is arranged inside. The tape feed mechanism section 25 performs power branching via the gear train and thus causes the platen drive shaft 45 and the take-up drive shaft 47 to rotate synchronously.

The print mechanism section 23 has the print head 21 made up of a thermal head, a head support frame 61 which supports the print head 21 and causes the print head 21 to swivel, a head release mechanism (not illustrated) which causes the print head 21 to swivel between a printing position and a retreat position via the head support frame 61, and the head cover 43 covering the print head 21 (and the head support frame 61).

The head release mechanism is actuated, interlocked with the opening/closing of the above open/close cover 7, thus causes the print head 21 to move (swivel) to the printing position, interlocked with the closing operation of the open/close cover 7, and causes the print head 21 to move (swivel) to the retreat position, interlocked with the opening operation. The print head 21, having moved to the printing position, abuts against the platen roller 120 of the tape cartridge 100 via the ink ribbon 110 and the print tape 102. The print head 21, having moved to the retreat position, is spaced apart from the platen roller 120. Thus, the print tape 102 and the ink ribbon 110 are prevented from interfering with the print head 21 at the time of loading or unloading the tape cartridge 100.

A plurality of heat generating elements is provided in the print head 21, and the plurality of heat generating elements is arrayed in the same direction as the axial direction of the platen roller 120. Then, printing is carried out by feeding the print tape 102 and the ink ribbon 110 and selectively driving the plurality of heat generating elements. The head cover 43 is formed in a substantially rectangular shape, as viewed in a plan view, and is integrally formed (molded) with the above loading base 31 (cartridge loading section 5). Also, the head cover 43 vertically largely protrudes from the loading base 31, allows the print head 21 to swivel inside the head cover 43, and functions on its outside as a loading guide for the tape cartridge 100.

The tape detection section 51 is made up of a plurality of microswitches 51*a*, is selectively engaged with a section to be detected 180 of the tape cartridge 100, described later, and detects the type including tape width, tape color, material and the like of the print tape 102. Then, on the basis of the result of the detection, the driving of the print head 21 and the tape feed mechanism section 25 is controlled.

Figure 7A:
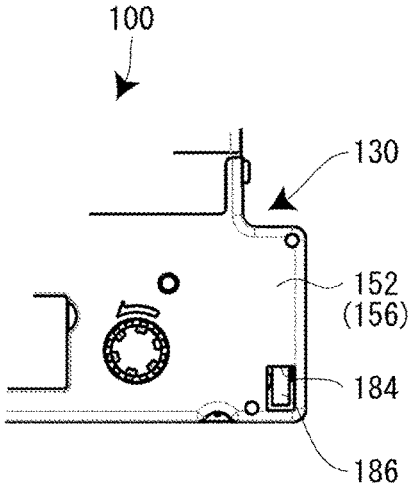
FIG. 7A is an enlarged plan view of the vicinities of a displacement portion of a tape cartridge according to a first embodiment.
Figure 7B:
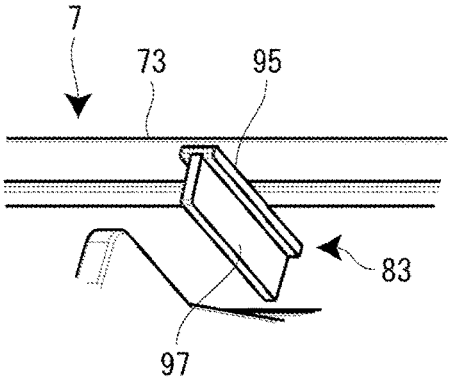
FIG. 7B is an enlarged perspective view of the vicinities of a protrusion to be detected.
Figure 7C:
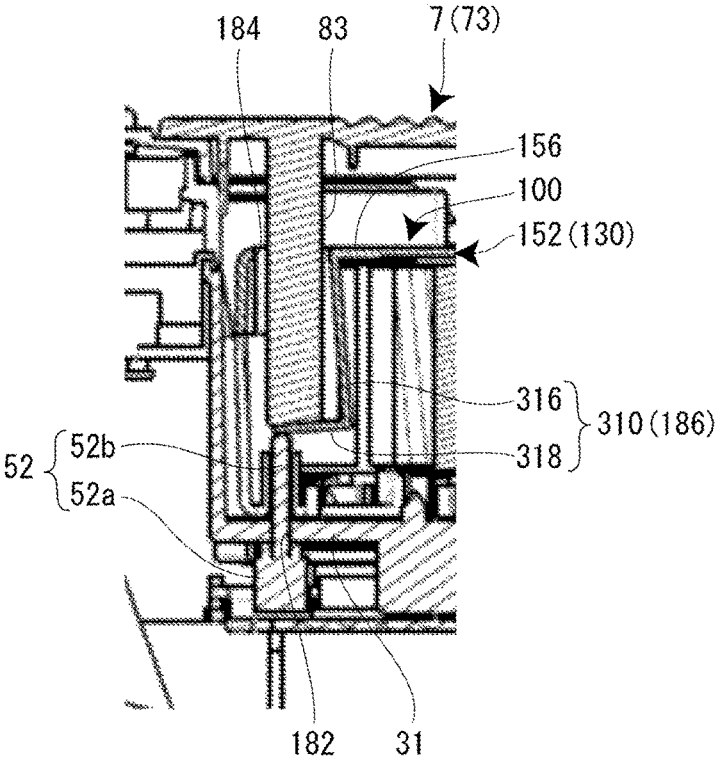
FIG. 7C is a cross-sectional view of the vicinities of the protrusion to be detected and a cover detection section.

The cover detection section 52 is made up of a push switch including a detection section main body 52*a* and a rod-like detector 52*b* (see FIG. 7C). The detection section main body 52*a* is arranged below the loading base 31, and the detector 52*b* is arranged in a protruding manner from the loading base 31 into the cartridge loading section 5. As the cover detection section 52 is actuated (turned ON) and the closing of the open/close cover 7 is detected, processing such as printing is enabled. Also, in the cover detection section 52, the detection section main body 52*a* may be made up of an optical sensor or the like.

The core release section 53 is made up of two cancellation pins 53*a* for the reel-off core 112 and the take-up core 116. As will be described in detail later, rotation stopper hooks 206 (see FIG. 6) to be hooked on the reel-off core 112 and the take-up core 116, respectively, are provided in the cartridge case 130. As the tape cartridge 100 is loaded, the cancellation pins 53*a* are engaged with these rotation stopper hooks 206, cancelling the rotation stopper of the reel-off core 112 and the take-up core 116.

The platen drive shaft 45 has a fixed shaft 45*a* provided in such a way as to be inserted through the platen roller 120, and a spline-shaped movable shaft 45*b* rotatably axially supported at a proximal part of the fixed shaft 45*a*. The rotational power of the tape feed mechanism section 25 is transmitted to this movable shaft 45*b* and further transmitted from the movable shaft 45*b* to the platen roller 120. Similarly, the take-up drive shaft 47 has a fixed shaft 47*a* and a spline-shaped movable shaft 47*b* rotatably axially supported on the fixed shaft 47*a*. In this case, too, the rotational power of the tape feed mechanism section 25 is transmitted to the movable shaft 47*b* and further transmitted from the movable shaft 47*b* to the take-up core 116.

When the tape cartridge 100 is loaded in the cartridge loading section 5, the core shaft 192 (tape core 104) is engaged with the positioning protrusion 41, and the platen roller 120 is engaged with the platen drive shaft 45. Also, the take-up core 116 is engaged with the take-up drive shaft 47. Then, as the open/close cover 7 is closed, the print head 21 swivels and abuts against the platen roller 120 via the print tape 102 and the ink ribbon 110. Thus, the tape printing device 1 enters into a print standby state.

Figure 4:
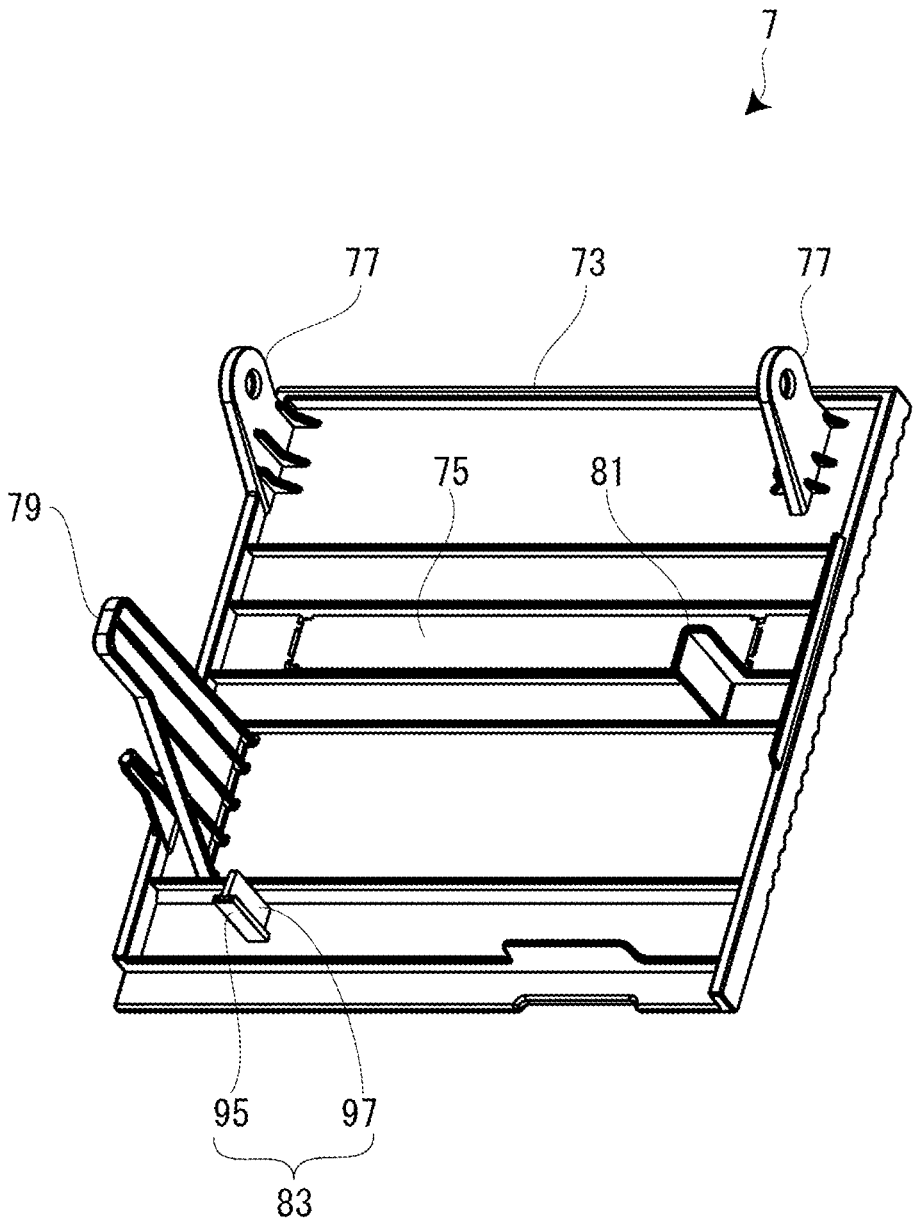
FIG. 4 is a perspective view of an open/close cover, as viewed from the back side.

As shown in FIG. 1 and FIG. 4, the open/close cover 7 is mounted on the device case 3 via a hinge portion 71 provided on the rear side, in such a way as to be able to swivel, that is, to be able to open/close. The open/close cover 7 includes an open/close cover main body 73, and a view window 75 provided at the center of the open/close cover main body 73. Also, the open/close cover 7 includes a pair of shaft support pieces 77 provided in a protruding manner on the back of the open/close cover main body 73 and axially supported on the hinge portion 71 in such a way as to be able to swivel, and an actuation lever 79 which is provided in a protruding manner on the back of the open/close cover main body 73 and causes the print head 21 to swivel.

Moreover, the open/close cover 7 includes a push-in protrusion 81 which is provided in a protruding manner on the back of the open/close cover main body 73 and pushes in the tape cartridge 100, and a protrusion to be detected 83 (element to be detected) which is provided in a protruding manner on the back of the open/close cover main body 73 and actuates (turns ON) the above cover detection section 52. As will be described in detail later, the protrusion to be detected 83 also has the function of pressing the tape cartridge 100 via a displacement portion 186 of the tape cartridge 100. Also, the "detection section" in the claims is formed by this cover detection section 52, and the "section to be detected (element to be detected)" is formed by this protrusion to be detected 83.

The view window 75 is formed to be laterally long and made of a transparent resin (transparent to visible rays) as a separate member from the open/close cover main body 73. Through this view window 75, the tape cartridge 100 loaded in the cartridge loading section 5 can be visually confirmed (the type of the print tape 102 and the amount of tape left). Also, the pair of shaft support pieces 77, the actuation lever 79, the push-in protrusion 81 and the protrusion to be detected 83, and the open/close cover main body 73 are integrally formed (molded) of a resin.

The actuation lever 79 protrudes largely from the back of the open/close cover main body 73. With the closing of the open/close cover 7, the actuation lever 79 is inserted in a slit opening 87 provided to the lateral side of the cartridge loading section 5. The actuation lever 79 inserted in the slit opening 87 actuates the above head release mechanism and causes the print head 21 to swivel toward the platen roller 120. The push-in protrusion 81 corresponds to a position near the platen roller 120 of the tape cartridge 100. With the closing of the open/close cover 7, the push-in protrusion 81 pushes in the tape cartridge 100 so that the tape cartridge 100 sits on the loading base 31 of the cartridge loading section 5.

The protrusion to be detected 83 is arranged near the actuation lever 79 and perpendicularly protrudes from the back side of the open/close cover main body 73. Also, the protrusion to be detected 83 is formed with a "T"-shaped cross section and is arranged in such away that the side of its flange piece 95 is directed toward the distal side of the open/close cover main body 73 while the side of its rib piece 97 is directed toward the proximal side of the open/close cover main body 73 (details will be described later). As will be described in detail later, with the closing of the open/close cover 7, the protrusion to be detected 83 is inserted in the tape cartridge 100 and actuates (turns ON) the cover detection section 52 via the displacement portion 186 of the tape cartridge 100.

[Details of Tape Cartridge]

Next, the tape cartridge 100 will be described in detail, referring to FIGS. 2A, 2B, 5A, 5B, and 6. In the description of the tape cartridge 100, taking FIGS. 2A and 2B as an example, the forward side in the loading direction, which is the top front side of the tape cartridge 100, is referred to as the "front side", the rear side in the loading direction, which is the opposite side, as the "back side", the lateral side on the left as the "left lateral side", the lateral side on the right as the "right lateral side", the arcuate side on the top (forward side) as the "distal side", and the side on the bottom (rear side) as the "proximal side".

The tape cartridge 100 includes the cartridge case 130, and the tape roll 106, the ribbon roll 114, the take-up core 116 and the platen roller 120 accommodated therein, as described above. Also, the tape cartridge 100 has the insertion opening 134 formed in the cartridge case 130, the tape outlet port 138 formed on the left lateral side, near the platen roller 120, and an identification seal 141 (see FIG. 1) bonded over the front side, the left lateral side and the right lateral side of the part where the tape roll 106 is accommodated. The identification seal 141 shows the tape width, tape color, material and the like of the accommodated print tape 102, at the two parts of the front side and the left lateral side.

The cartridge case 130 forms the outer shell of the tape cartridge 100 (shell structure) and has an "L"-shaped appearance as viewed in a plan view, with the proximal side part on the right lateral side slightly protruding. In the front-back direction, the cartridge case 130 is formed by a lower case 150 which comes to the rear side when the tape cartridge is loaded in the cartridge loading section 5, and an upper case 152 which comes to the forward side. In the cartridge case 130 in this embodiment, the upper case 152 is formed by a molded member of a transparent resin, and the lower case 150 is formed by a molded member of an opaque resin.

The upper case 152 is integrally formed (molded) by a top wall portion 156 forming the front side of the cartridge case 130, and an upper circumferential wall portion 158 suspended on a circumferential edge part of the top wall portion 156. Meanwhile, the lower case 150 is integrally formed (molded) by a bottom wall portion 160 forming the back side of the cartridge case 130, a lower circumferential wall 162 provided upright on a circumferential edge part of the bottom wall portion 160, and an opening circumferential wall portion 164 provided upright on the bottom wall portion 160 so as to define the above insertion opening 134.

Figures 5A, 5B:
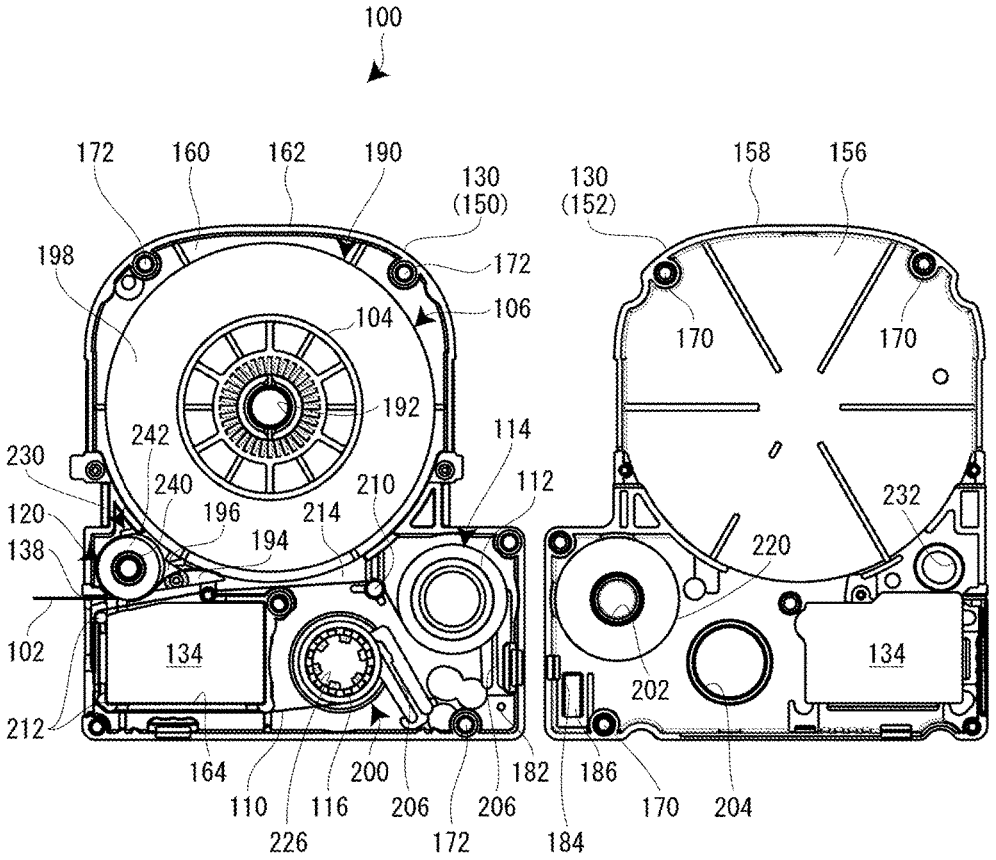
FIG. 5A is a plan view of an upper case and the tape cartridge in the state where the upper case is removed.
FIG. 5B is a back view of the upper case.

A plurality of joint pins 170 is provided at a proper interval on a lower end surface of the upper circumferential wall portion 158 of the upper case 152, whereas a plurality of joint holes 172 corresponding to the plurality of joint pins 170 is provided in the lower circumferential wall 162 of the lower case 150 (see FIGS. 5A and 5B). After components such as the tape roll 106 and the ribbon roll 114 are set in the lower case 150, the upper case 152 is joined thereto in such a way that the plurality of joint pins 170 is press-fitted in the plurality of joint holes 172, thus assembling the tape cartridge 100. Each joint hole 172 is a through-hole in consideration of easiness of molding.

Figure 2A:
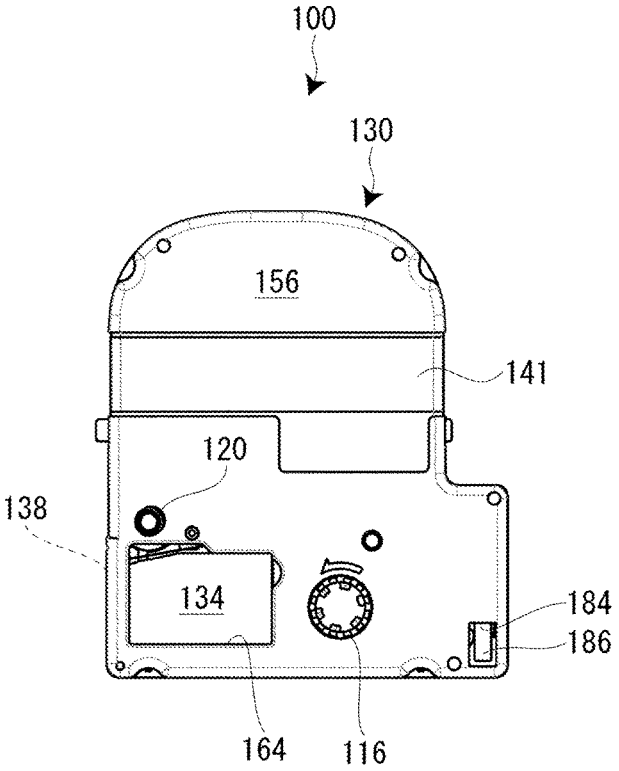
FIG. 2A is a plan view and FIG. 2B is a side view of the tape cartridge.
Figure 2B:
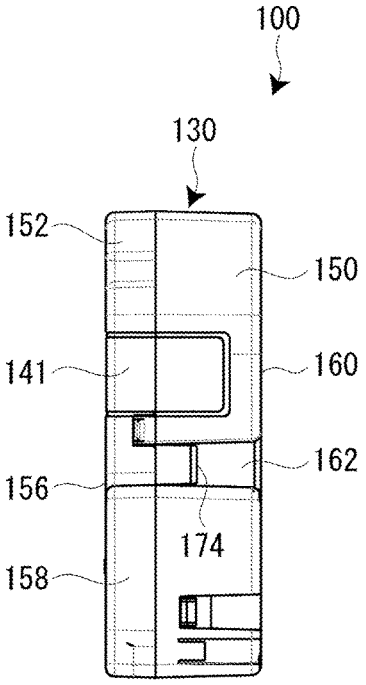
Figure 6:
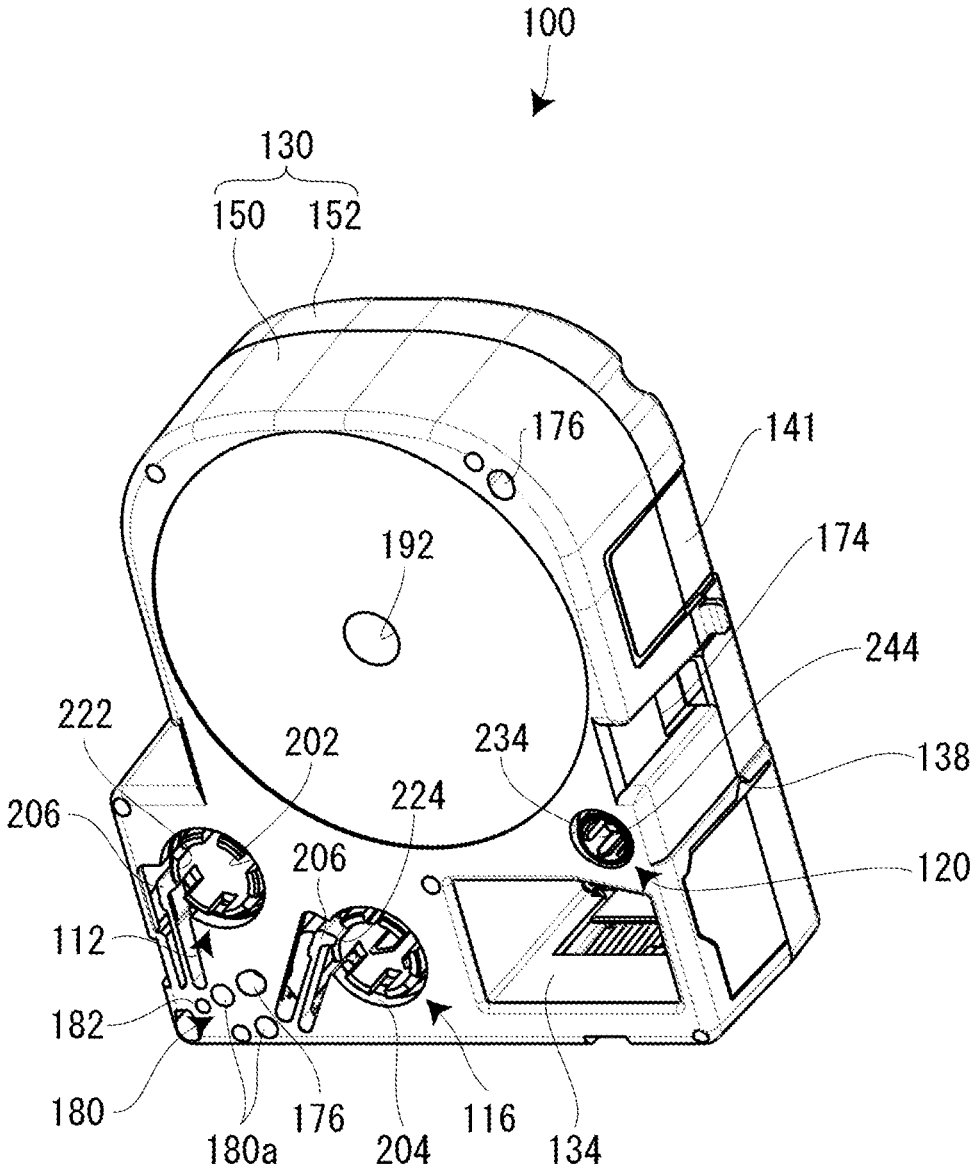
FIG. 6 is a perspective view of the tape cartridge, as viewed from the back side.

Meanwhile, a pair of hook receiving portions 174 to be hooked on the above pair of hook pieces 57 is provided on the left lateral side and the right lateral side of the lower case 150 (see FIGS. 2A and 2B and FIG. 6). As the pair of hook pieces 57 on the side of the cartridge loading section 5 is hooked on the pair of hook receiving portions 174 of the loaded tape cartridge 100, the tape cartridge 100 is prevented from floating up. Also, fitting small holes 176 in which the above pair of small protrusions 55 is fitted with a certain margin are provided on the back side of the lower case 150 (see FIG. 6). As the pair of small protrusions 55 on the side of the cartridge loading section 5 is fitted in the pair of fitting small holes 176 in the loaded tape cartridge 100, the tape cartridge 100 is easily positioned on the loading base 31.

Moreover, on the back side (bottom wall portion 160) of the lower case 150, the section to be detected 180 corresponding to the above tape detection section 51 is provided at a position in the left corner on the proximal side (right corner as viewed from the front side) (see FIG. 6). The section to be detected 180 is formed by a section corresponding to the plurality of microswitches 51*a* of the tape detection section 51, and a plurality of bit patterns is acquired according to the presence/absence of receiving holes 180*a* provided in this section. That is, the bit patterns correspond to the type of the above print tape 102.

Also, on the back side (bottom wall portion 160) of the lower case 150, a circular back receiving opening 182 (second receiving opening) in which the detector 52*b* of the cover detection section 52 is loosely inserted is formed near the section to be detected 180 (see FIG. 6). As described above, in the cartridge loading section 5, the detector 52*b* is provided in a protruding manner from the loading base 31. As the tape cartridge 100 is loaded in the cartridge loading section 5, the detector 52*b* is inserted in the tape cartridge 100 from this back receiving opening 182.

Meanwhile, in the right corner on the proximal side of the front side (top wall portion 156) of the tape cartridge 100, that is, in the right corner on the proximal side of the front side of the upper case 152, a front receiving opening 184 (first receiving opening) in which the above protrusion to be detected 83 is inserted, and the displacement portion 186 against which the protrusion to be detected 83 inserted from the front receiving opening 184 abuts, are provided (see FIGS. 2A and 2B and FIGS. 5A and 5B).

As will be described in detail later, as the open/close cover 7 is closed, the protrusion to be detected 83 provided on the open/close cover 7 is inserted in the tape cartridge 100 from the front receiving opening 184 and presses the displacement portion 186. The displacement portion 186 thus pressed is elastically deformed, and by the resulting elastic force, the tape cartridge 100 itself is pressed to the cartridge loading section 5 (loading base 31), with the open/close cover 7 as a support. At the same time, the above detector 52*b* inserted in the back receiving opening 182 is pressed by the elastically deformed displacement portion 186, thus actuating (turning ON) the cover detection section 52 (details will be described later).

As shown in FIGS. 5A and 5B, a broad tape accommodation area 190 in which the tape roll 106 is accommodated is formed in a space on the upper side (distal side) in the cartridge case 130. At the center of the tape accommodation area 190, the core shaft 192 integrally formed (molded) with the lower case 150 is provided upright. The core shaft 192 is cylindrically formed, and on its outer circumferential surface, the tape roll 106 (tape core 104) is rotatably axially supported. Also, in the tape accommodation area 190, near the platen roller 120, a tape guide 194 which guides the reeled-off print tape 102 to the platen roller 120 is provided upright integrally with the lower case 150.

That is, inside the cartridge case 130, a tape feed path 196 is formed, starting at the tape roll 106 and reaching the tape outlet port 138 via the tape guide 194 and the platen roller 120. The print tape 102 reeled off from the tape roll 106 is guided to the platen roller 120 via the tape guide 194, used for printing there, and further guided from the platen roller 120 to the tape outlet port 138.

The tape roll 106 has the print tape 102 and the tape core 104, and also has two films 198 bonded to both end surfaces of the print tape 102 in a roll shape. The two films 198 prevent the print tape 102 wound on the tape core 104 from unwinding. Also, a reverse rotation stopper mechanism is incorporated in the tape core 104, though not illustrated. When carrying the tape cartridge 100, reverse rotation of the print tape 102 is prevented by this reverse rotation stopper mechanism. Meanwhile, when the tape cartridge 100 is loaded in the cartridge loading section 5 of the tape printing device 1, the reverse rotation stopper by the reverse rotation stopper mechanism is cancelled by the above positioning protrusion 41, thus enabling the print tape 102 to be fed.

On the right side of the proximal part in the cartridge case 130, a ribbon accommodation area 200 is formed next to the insertion opening 134. To the right in the ribbon accommodation area 200, a reel-off side bearing portion 202 which rotatably supports the ribbon roll 114 (reel-off core 112), and to the left, a take-up side bearing portion 204 which rotatably supports the take-up core 116, are formed integrally with the cartridge case 130. That is, the reel-off side bearing portion 202 and the take-up side bearing portion 204 are formed each in the upper case 152 and the lower case 150.

In cut-out parts of the reel-off side bearing portion 202 and the take-up side bearing portion 204 formed in the lower case 150, rotation stopper hooks 206 having their distal parts facing the reel-off side bearing portion 202 and the take-up side bearing portion 204 are integrally formed, respectively. Then, one rotation stopper hook 206 is engaged with the reel-off core 112 and the other rotation stopper hook 206 is engaged with the take-up core 116, each in a rotation stopping state.

In the ribbon accommodation area 200, near the reel-off side bearing portion 202, a first ribbon guide 210 which guides the reeled-off ink ribbon 110 to the platen roller 120 is provided upright integrally with the lower case 150. Also, on the outer circumferential side of the above opening circumferential wall portion 164, a plurality of second ribbon guides 212 which guides the circular movement of the ink ribbon 110 is integrally formed.

That is, inside the cartridge case 130, a ribbon feed path 214 is formed, starting at the ribbon roll 114 and reaching the take-up core 116 via the first ribbon guide 210, the platen roller 120 and the plurality of second ribbon guides 212. The ink ribbon 110 reeled off from the ribbon roll 114 is guided to the platen roller 120 via the first ribbon guide 210, is used for printing there, then further travels around the opening circumferential wall portion 164 (the plurality of second ribbon guides 212) from the platen roller 120, and is taken up on the take-up core 116.

The ribbon roll 114 has the ink ribbon 110 and the reel-off core 112, and also has a ring-shaped leaf spring 220 which applies a braking load to the reel-off core 112 (see FIG. 5B). The leaf spring 220 is formed in a wave shape in the circumferential direction and is provided between the top wall portion 156 of the upper case 152 and the reel-off core 112 in the axial direction. That is, a rotation braking load is applied to the reel-off core 112 by the spring force of this leaf spring 220. Thus, a back tension is applied to the ink ribbon 110 being reeled off by the take-up core 116, preventing the ink ribbon 110 from loosening.

The reel-off core 112 is cylindrically formed, and at its end on the side of the lower case 150, a plurality of cut-outs 222 is formed in the circumferential direction (see FIG. 6). Then, the above rotation stopper hooks 206 are to be engaged with and disengaged from the plurality of cut-outs 222. While the reel-off side bearing portion 202 on the side of the lower case 150 supporting the reel-off core 112 is formed as a circular opening, the reel-off side bearing portion 202 on the side of the upper case 152 is formed as a cylindrical protruding part. Then, the above leaf spring 220 is mounted on this protruding part (see FIG. 5B for each of these parts).

Similarly, the take-up core 116 is cylindrically formed, and at its end on the side of the lower case 150, a plurality of cut-outs 224 is formed in the circumferential direction. Then, the above rotation stopper hooks 206 are engaged with and disengaged with the plurality of cut-outs 224. Also, a spline groove 226 is formed on the inner circumferential surface of the take-up core 116 and spline-engaged with the above take-up drive shaft 47. Thus, the rotational force of the take-up drive shaft 47 is transmitted to the take-up core 116, and the ink ribbon 110 is taken up.

On the left side of the proximal part in the cartridge case 130, a platen accommodation area 230 is formed next to the insertion opening 134. In the center of the platen accommodation area 230, a lower bearing portion 234 (see FIG. 6) in the form of an elliptic opening formed in the lower case 150, and an upper bearing portion 232 (see FIG. 5B) in the form of an elliptic opening formed in the upper case 152 are provided. Then, on the upper bearing portion 232 and the lower bearing portion 234, the platen roller 120 is supported in a rotatable and slightly movable (laterally movable) manner. That is, the platen roller 120 supported on the elliptic upper bearing portion 232 and lower bearing portion 234 is configured to be movable (finely movable) between a home position where the platen roller 120 is engaged with the platen drive shaft 45 and a nipping position where the platen roller 120 abuts against the tape guide 194 with the print tape 102 nipped between them.

Incidentally, this tape cartridge 100 is carried in the state where the reel-off end of the print tape 102 is slightly protruding outward from the tape outlet port 138 (see FIG. 1). In this case, if a push-in force or pull-in force acts on the reel-off end of the print tape 102 by mistake, the platen roller 120, which is drawn by this, moves to the above nipping position. Thus, the reel-off end of the print tape 102 is prevented from being pulled into the cartridge case 130 from the tape outlet port 138.

The platen roller 120 has a cylindrical roller base 240 and a rubber roller 242 mounted on the outer circumferential surface of the roller base 240. The rubber roller 242 has a length corresponding to the print head 21 in the axial direction. The print head 21, having moved to the printing position, abuts against this rubber roller 242 with the print tape 102 and the ink ribbon 110 nipped between them. Also, a spline groove 244 is formed on the inner circumferential surface of the roller base 240 and spline-engaged with the above platen drive shaft 45. Thus, the rotational force of the platen drive shaft 45 is transmitted to the platen roller 120, and the print tape 102 (and the ink ribbon 110) is fed for printing.

[First Embodiment of Cover Detection]

Next, referring to FIGS. 8A-8D, the structures of the protrusion to be detected 83 (element to be detected) of the open/close cover 7 and the cover detection section 52 (detection section) according to the first embodiment will be described in detail along with the structure of the displacement portion 186 of the tape cartridge 100.

As described above, the displacement portion 186 is provided in the right corner on the proximal surface side of the top wall portion 156 of the upper case 152. Also, the protrusion to be detected 83 corresponding to this is provided in such a way as to protrude on the back side of the open/close cover 7 (open/close cover main body 73). The detector 52*b* of the cover detection section 52 is arranged in such a way as to protrude from the loading base 31 in the cartridge loading section 5.

As shown in FIGS. 7(*a*) and (*c*), the displacement portion 186 has an elastic piece 310 with an "L"-shaped cross section which extends inward from the top wall portion 156 of the upper case 152. As described above, the front receiving opening 184, which receives the protrusion to be detected 83, is formed in the top wall portion 156, and the back receiving opening 182, in which the detector 52*b* is inserted, is formed in the bottom wall portion 160.

The elastic piece 310 is made up of a suspended piece part 316 extending from the top wall portion 156, and an abutting piece part 318 which the protrusion to be detected 83 is made to strike (abut against), and is formed (molded) integrally with the upper case 152. Then, the elastic piece 310 is elastically deformed by the pressing of the protrusion to be detected 83 and thus causes the detector 52*b* to operate (turns the cover detection section 52 ON), and also relatively presses the tape cartridges 100 to the loading base 31 and positions the tape cartridge 100 in the loading direction.

The elastic piece 310 (abutting piece part 318) is formed in a rectangular shape as viewed in a plan view, whereas the front receiving opening 184 is formed in a rectangular shape slightly larger than the elastic piece 310. Also, the elastic piece 310 (abutting piece part 318) extends from the distal side toward the proximal side of the upper case 152, in parallel with the right lateral side of the upper case 152. As the pressing force of the protrusion to be detected 83 acts on the elastic piece 310, the abutting piece part 318 flexes downward and the suspended piece part 316 flexes rearward at the same time, thus exerting an elastic force (spring force).

As shown in FIG. 7C, the elastic piece 310 is displaced by the pressing force of the protrusion to be detected 83 when the open/close cover 7 is closed, and also applies a counterforce which increases according to (preferably, increases in proportion to) the amount of displacement, to the protrusion to be detected 83. In other words, with the protrusion to be detected 83 as a support, the tape cartridge 100 is pressed to the loading base 31 by its own elastic piece 310. Therefore, the elastic force of the elastic piece 310 is designed to restrain the misalignment of the tape cartridge 100 in the loading direction.

More specifically, the tape cartridge 100 receives the pressing force of the print head 21 via the platen roller 120, and also receives the rotational forces around the platen roller 120 and the take-up core 116 with the rotations of the platen roller 120 (platen drive shaft 45) and the take-up core 116 (take-up drive shaft 47). Therefore, the tape cartridge 100 receives the force resulting from the combination of these pressing force and rotational forces, and also receives component forces thereof, thus becoming misaligned or floating up on the loading base 31. The elastic force of the elastic piece 310 in the embodiment positions the tape cartridge 100 in a predetermined position, against the resulting force and its component forces.

As described above, as the tape cartridge 100, a plurality of types with different thicknesses is prepared. Therefore, it is preferable that the abutting piece part 318 of the elastic piece 310 is arranged in such a way as to be at the same position in the up-down direction in FIG. 7C, in these tape cartridges 100 with different thicknesses. Thus, the detector 52*b* can be securely actuated in the tape cartridges 100 with different thicknesses.

Meanwhile, as shown in FIG. 7B, the protrusion to be detected 83 is formed with a "T"-shaped cross section and protrudes perpendicularly from the back side of the open/close cover main body 73. The open/close cover main body 73 and the protrusion to be detected 83 are integrally molded of a resin or the like. Since the protrusion to be detected 83 has a "T"-shaped cross section, molding defects such as sink marks are prevented. The protrusion to be detected 83 with a "T"-shaped cross section is arranged in such a way that the side of the flange piece 95 is directed toward the distal side of the open/close cover main body 73 while the side of the rib piece 97 is directed toward the proximal side of the open/close cover main body 73. Also, the distal end of the protrusion to be detected 83 is formed as a slope following the shape of the deformed elastic piece 310, and the entire area of the distal end presses the elastic piece 310.

As shown in FIG. 7C, the detector 52*b* of the cover detection section 52 is arranged directly below the protrusion to be detected 83, with the abutting piece part 318 held in-between. More specifically, in the state where the open/close cover 7 is closed, the detector 52*b* is arranged coaxially to the protrusion to be detected 83. Also, the distal end of the detector 52*b* contacts the lower surface (back side) of the abutting piece part 318 or faces this with a very small gap. Then, as the pressing force of the protrusion to be detected 83 acts on the elastic piece 310, the abutting piece part 318 flexes downward, and at the same time, the detector 52*b* is pressed, thus causing the detection section main body 52*a* of the cover detection section 52 to operate (turn ON). Thus, it is detected that the open/close cover 7 has closed the cartridge loading section 5.

As described above, according to the first embodiment, as the open/close cover 7 is closed, its protrusion to be detected 83 elastically deforms the elastic piece 310 and also presses the detector 52*b* via the elastic piece 310. Thus, the tape cartridge 100 is pressed to the loading base 31 (cartridge loading section 5) by the protrusion to be detected 83 via the elastic piece 310 and is thus positioned. At the same time, by the pressing of the detector 52*b*, the cover detection section 52 operates and the closing of the open/close cover 7 is detected.

In this way, according to the first embodiment, the cover detection section 52 is actuated for detection via the displacement portion 186 (elastic piece 310). Therefore, not only the opening/closing (closing) of the open/close cover 7 can be detected but also the presence/absence (presence) of the tape cartridge 100 can be detected as well. Thus, there is no need to detect the presence/absence of the tape cartridge 100 by the above tape detection section 51. Also, since the detector 52*b* is pressed by the elastically deformed displacement portion 186 (elastic piece 310), the misalignment of the tape cartridge 100 can be prevented with an extremely simple structure. Thus, the print quality can be stabilized.

Moreover, since the cover detection section 52 can be arranged inside the cartridge loading section 5, there is no need to increase the size of the open/close cover 7 by that amount. Also, in the cartridge loading section 5, the degree of freedom in the installation of the cover detection section 52 can be increased. While the abutting piece part 318 in the embodiment has a simple rectangular shape, its shape may be arbitrary such as a keyhole shape, for example.

[Modifications of Displacement Portion in First Embodiment]

Figure 8A:
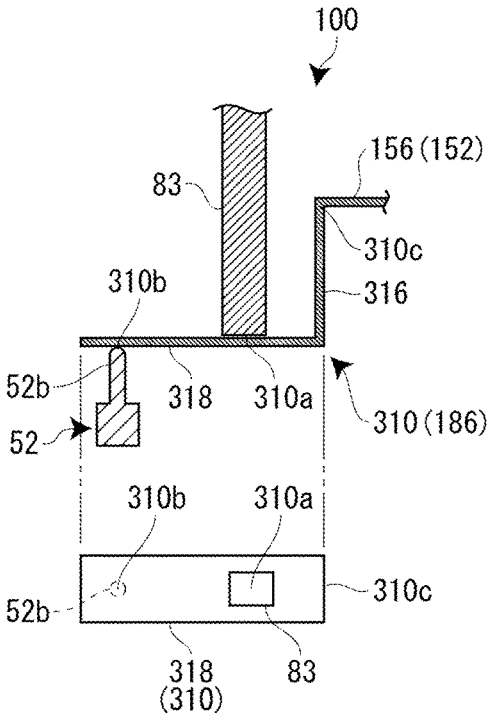
FIG. 8A is a structural view of the vicinities of a displacement portion according to a first modification of the first embodiment.
Figure 8B:
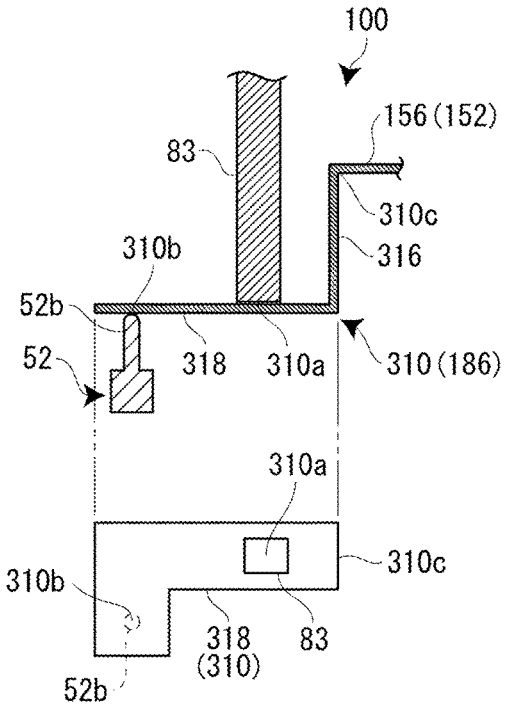
FIG. 8B is a structural view of the vicinities of a displacement portion according to a second modification.
Figure 8C:
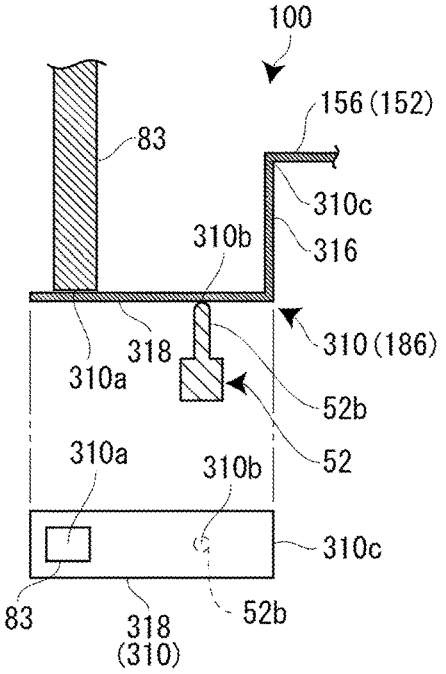
FIG. 8C is a structural view of the vicinities of a displacement portion according to a third modification.
Figure 8D:
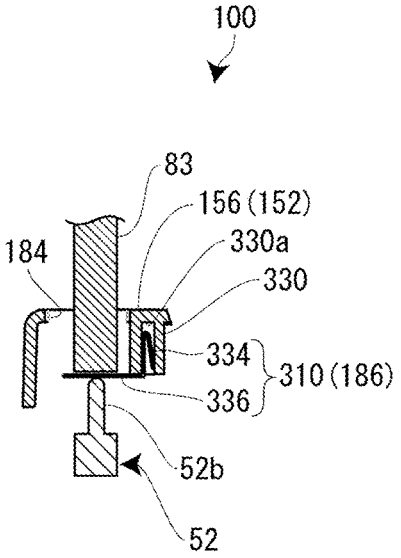
FIG. 8D is a structural view of the vicinities of a displacement portion according to a fourth modification.

Next, referring to FIGS. 8A-8D, modifications of the displacement portion 186 in the first embodiment, and the protrusion to be detected 83 and the cover detection section 52 corresponding to these, will be described. FIG. 8A is a first modification. FIG. 8B is a second modification. FIG. 8C is a third modification. FIG. 8D is a fourth modification.

As shown in FIG. 8A, in the first modification, the abutting piece part 318 of the elastic piece 310 extends further forward, and the distal end part of the abutting piece part 318 presses the detector 52*b*. That is, the axial line of the protrusion to be detected 83 and the axial line of the detector 52*b* are misaligned from each other in the forward-rear direction (distal-proximal direction). This means that the position where the protrusion to be detected 83 provided on the open/close cover 7 abuts and the position where the detector abuts in the section to be detected 180, are misaligned from each other as viewed from the loading/unloading direction.

Specifically, in a plane parallel to the loading base 31 (as viewed from the loading direction of the tape cartridge 100), an input part 310*a* where the protrusion to be detected 83 abuts against the elastic piece 310 (abutting piece part 318), and an output part 310*b* where the elastic piece 310 (abutting piece part 318) abuts against the detector 52*b*, are misaligned from each other in the forward-rear direction. Also, compared with the distance from a support part 310*c* of the upper case 152, which is the proximal part of the elastic piece 310 (suspended piece part 316), to the input part 310*a*, the distance from the support part 310*c* to the output part 310*b* is longer in the forward-rear direction.

In such a configuration, the vicinity of the support part 310*c* approximately functions as the center of rotational displacement, the detector 52*b* can be actuated with a relatively small amount of displacement of the elastic piece 310, utilizing the principle of leverage. In other words, even when the actuator stroke of the detector 52*b* is large, the detector 52*b* can be securely actuated.

As shown in FIG. 8B, in the second modification, the distal end part of the abutting piece part 318 is formed in an "L"-shape, and the detector 52*b* is misaligned from the protrusion to be detected 83 in the left-right direction as well as in the forward-rear direction. For example, the installation space for the cover detection section 52 is limited, and the planar shape (distal end part or the like) of the abutting piece part 318 is freely deformed so as to coincide with the position of the detector 52*b*. With this, the detector 52*b* can be properly actuated even when the position of the protrusion to be detected 83 and the position of the detector 52*b* are misaligned in the forward-rear and left-right directions.

As shown in FIG. 8C, in the third modification, unlike the first modification, the distance from the support part 310*c* to the output part 310*b* is shorter in the forward-rear direction than the distance from the support part 310*c*, which is the proximal part of the elastic piece 310 (suspended piece part 316), to the input part 310*a*. In this case, the detector 52*b* can be actuated with a relatively small pressing force of the elastic piece 310, utilizing the principle of leverage.

As shown in FIG. 8D, in the fourth modification, the elastic piece 310 (displacement portion 186) is formed by a leaf spring and held on a holding part 330 provided in the upper case 152. The elastic piece 310 includes a proximal spring piece part 334 bent into a "V"-shape, and an abutting spring piece part 336 extending parallel to the top wall portion 156 from the proximal spring piece part 334, and is held in a holding groove 330*a* formed in the holding part 330, by the proximal spring piece part 334.

In such a configuration, too, the opening/closing of the open/close cover 7 can be detected and the presence/absence of the tape cartridge 100 can be detected. Also, the degree of freedom in the arrangement of the cover detection section 52 (detector 52*b*) in relation to the protrusion to be detected 83 can be increased. Moreover, the tape cartridge 100 can be positioned. Particularly, by preparing the elastic piece 310 corresponding to the thickness of the tape cartridge 100, it is possible to cope with tape cartridges 100 with difference thicknesses.

[Modification of Protrusion to be Detected in First Embodiment]

Figure 9:
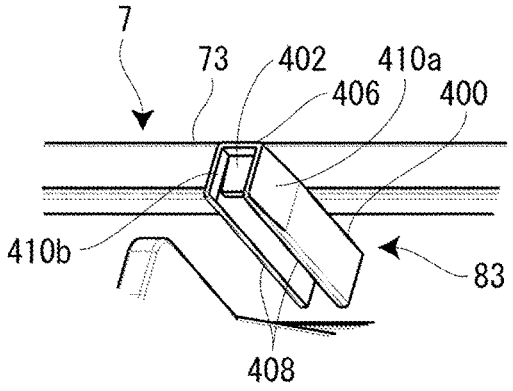
FIG. 9 is an enlarged perspective view of a modification of the protrusion to be detected in the first embodiment.

Next, referring to FIG. 9, a modification of the protrusion to be detected 83 in the first embodiment will be described. As shown in FIG. 9, in this modification, the protrusion to be detected 83 on the open/close cover 7 includes a columnar protrusion 400 with a "U"-shaped cross section, and a pressing piece portion 402 provided at a distal part of the columnar protrusion 400.

The pressing piece portion 402 is formed integrally with the columnar protrusion 400 and in the shape of a plate intersecting with the extending direction of the columnar protrusion 400. Also, the pressing piece portion 402 is arranged at a position slightly set back from the edge of the columnar protrusion 400. Also, this pressing piece portion 402 abuts against the abutting piece part 318 of the above elastic piece 310 and presses and deforms the abutting piece part 318.

The outline of the columnar protrusion 400 is formed in a complementary shape to the front receiving opening 184, and the columnar protrusion 400 is to be fitted in the front receiving opening 184. The columnar protrusion 400 with a "U"-shaped cross section is arranged in such a way that the side of its flange piece 406 is arranged on the distal side of the open/close cover main body 73 and that a pair of rib pieces 408 is parallel to the lateral side of the open/close cover main body 73.

Also, in order to guide this fitting, an outer guide slope 410*a* narrowing toward the edge is formed on the outer surface (three sides) of the distal end part of the columnar protrusion 400. Similarly, in order to guide the abutment of the pressing piece portion 402 against the abutting piece part 318, an inner guide slope 410*b* enlarging toward the edge is formed on the inner surface (three sides) of the distal end part of the columnar protrusion 400.

With the closing of the open/close cover 7, the columnar protrusion 400 (protrusion to be detected 83) is guided by the outer guide slope 410*a* and thus fitted in the front receiving opening 184, and the pressing piece portion 402 is also guided by the inner guide slope 410*b* and made to strike the abutting piece part 318 (abutment). In this state, the three sides on the outside of the columnar protrusion 400 contact the corresponding three sides of the front receiving opening 184, and the tape cartridge 100 is positioned by the protrusion to be detected 83 (columnar protrusion 400) via the front receiving opening 184. Also, the three sides on the inside of the distal end part of the columnar protrusion 400 contact the corresponding three sides of the abutting piece part 318, and the tape cartridge 100 is positioned by the protrusion to be detected 83 (columnar protrusion 400) via the abutting piece part 318.

In this modification, with the closing of the open/close cover 7, the protrusion to be detected 83 is fitted in the front receiving opening 184 and presses the displacement portion 186 in the positioned state. Therefore, the tape cartridge 100 is pressed to the loading base 31 and positioned in the loading direction (front-back direction), and also positioned in the forward-rear and left-right directions on the loading base 31. Thus, the detection of the closing of the open/close cover 7 and the detection of the presence/absence of the tape cartridge 100 are enabled, and the misalignment of the tape cartridge 100 can be effectively prevented. Thus, the print quality can be stabilized further.

[Second Embodiment of Cover Detection]

Next, referring to FIG. 10, the structures of the protrusion to be detected 83 of the open/close cover 7 and the cover detection section 52 according to the second embodiment will be described in detail along with the structure of the displacement portion 186 of the tape cartridge 100. Also, in the second embodiment, different parts from the first embodiment will be mainly described.

Figure 10:
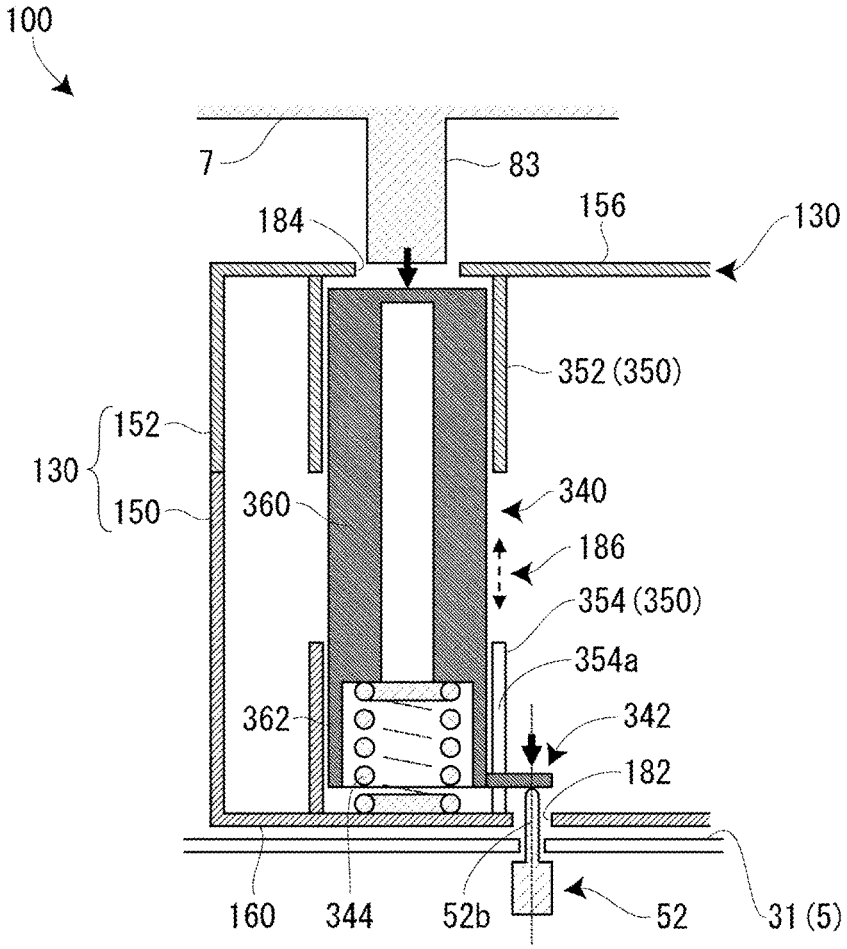
FIG. 10 is a cross-sectional view of the vicinities of a protrusion to be detected and a cover detection section according to a second embodiment.

As shown in FIG. 10, in the second embodiment, the displacement portion 186A is arranged directly below the protrusion to be detected 83, whereas the detector 52*b* is arranged at a position shifted forward (to the distal side) from directly below the protrusion to be detected 83. The displacement portion 186 includes an input portion 340 against which the protrusion to be detected 83 abuts, an output portion 342 which is provided at a proximal part of the input portion 340 and presses the detector 52*b* down, and an elastic member 344 which receives the input portion 340 and the output portion 342 at an initial position for receiving the protrusion to be detected 83.

Also, a slide guide 350 which guides the movement of the input portion 340 in the up-down direction (direction of thickness of the tape cartridge 100) is provided in the cartridge case 130. The slide guide 350 includes an upper guide 352 suspended integrally with the upper case 152, and a lower guide 354 provided upright integrally with the lower case 150. Also, a guide cut-out portion 354*a* faced by the output portion 342 is provided in the lower guide 354.

The input portion 340 includes a cylindrical input portion main body 360, and a skirt portion 362 stretching at the lower end of the input portion main body 360. The elastic member 344 formed by a leaf spring is arranged on the inside of the skirt portion 362, and the output portion 342 is provided in such a way as to protrude in a radial direction is provided on the outer surface of a lower end part of the skirt portion 362. The input portion main body 360, the skirt portion 362 and the output portion 342 are integrally formed (molded) of a resin or the like. Also, the detector 52*b* abuts against the lower surface of the output portion 342.

The elastic member 344 formed by a leaf spring sits on the bottom wall portion 160 of the lower case 150 and receives the input portion 340. The elastic member 344 is formed by a compression coil spring and receives the input portion 340, as illustrated, at an initial position where its upper end faces the upper case 152 (top wall portion 156) with a very small space in-between or in such a way as to strike the upper case 152.

As the protrusion to be detected 83 presses the input portion 340, the input portion 340 and the output portion 342 move downward against the elastic member 344, and the output portion 342 presses the detector 52*b* down. Also, as the protrusion to be detected 83 comes off upward, the elastic member 344 causes the input portion 340 and the output portion 342 return to the original initial position.

In this way, in the second embodiment, too, the cover detection section 52 is made to operate (turn ON) via the displacement portion 186. Therefore, not only the opening/closing of the open/close cover 7 can be detected but also the presence/absence of the tape cartridge 100 can be detected. Also, the elastic member 344 of the displacement portion 186 relatively presses the tape cartridge 100 and enables its positioning.

[Modifications of Second Embodiment]

Figure 11A:
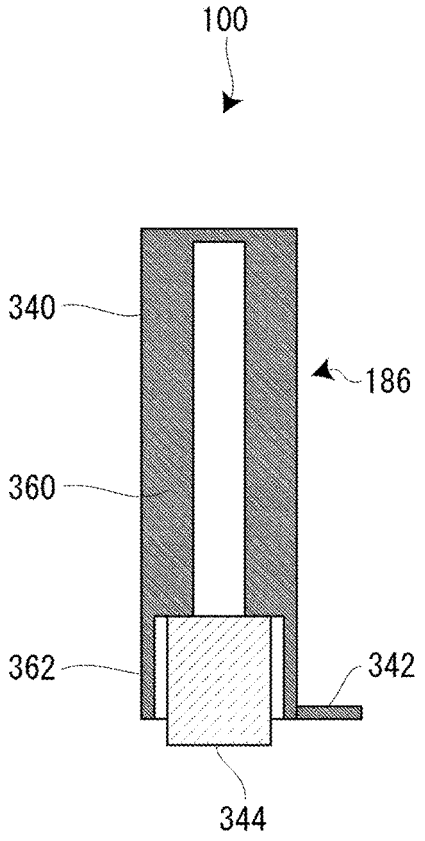
FIG. 11A is a cross-sectional view of the vicinities of a protrusion to be detected and a cover detection section according to a first modification of the second embodiment.
Figure 11B:
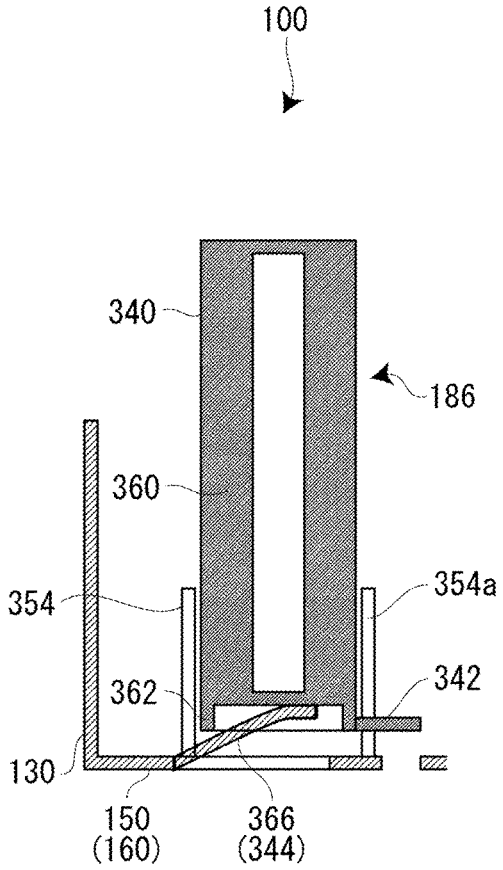
FIG. 11B is a cross-sectional view of the vicinities of a protrusion to be detected and a cover detection section according to a second modification.

Next, referring to FIGS. 11A and 11B, modifications of the second embodiment will be described. FIG. 11A is a first modification. FIG. 11B is a second modification.

In the first modification of FIG. 11A, the elastic member 344 is made of a rubber or sponge or the like, instead of the above coil spring.

In the second modification of FIG. 11B, the elastic member 344 is made up of a spring piece 366 formed by cutting and raising upward a part of the bottom wall portion 160 of the lower case 150. In this case, the skirt portion 362 of the input portion 340 is made short, and the spring piece 366 receives the input portion 340 at the lower end of its input portion main body 360.

In this way, in the modifications of the second embodiment, the elastic member 344 can be formed with a simple structure. Particularly in the second modification, the number of components of the tape cartridge 100 can be reduced.

[Third Embodiment of Cover Detection]

Next, referring to FIG. 12, the structures of the protrusion to be detected 83 of the open/close cover 7 and the cover detection section 52 according to the third embodiment will be described in detail along with the structure of the displacement portion 186 of the tape cartridge 100. Also, in the third embodiment, different parts from the first embodiment will be mainly described.

Figure 12:
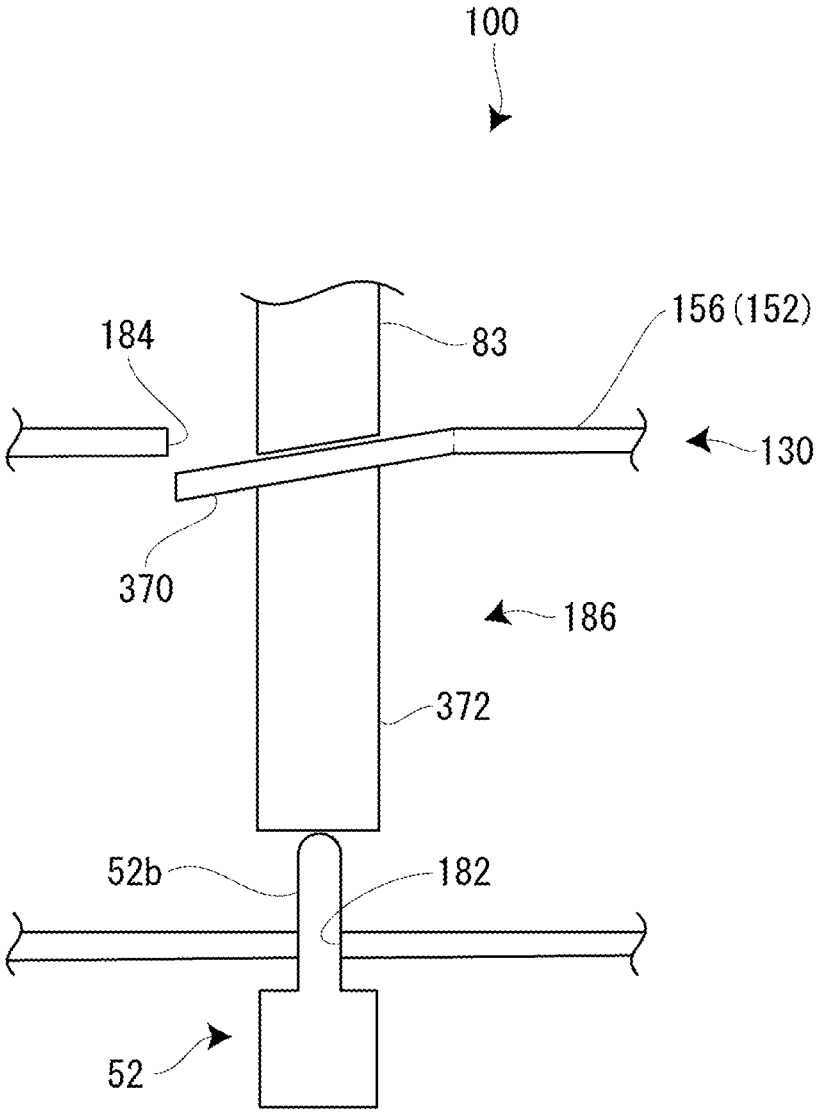
FIG. 12 is a cross-sectional view of the vicinities of a protrusion to be detected and a cover detection section according to a third embodiment.

As shown in FIG. 12, in the third embodiment, the displacement portion 186 includes an input elastic portion 370 which is elastically deformed by the pressing force of the protrusion to be detected 83, and an output actuation portion 372 which continues from the input elastic portion 370 and actuates the detector 52*b* with the elastic deformation of the input elastic portion 370.

The input elastic portion 370 is formed by eliminating a part of the top wall portion 156 in a "U"-shape. The output actuation portion 372 is formed in a rod-like shape and fixed to the lower surface of the input elastic portion 370. As the protrusion to be detected 83 presses the input elastic portion 370, the input elastic portion 370 is elastically deformed and moves the output actuation portion 372 downward. The output actuation portion 372, thus moved downward, presses the detector 52*b* down.

In this way, in the tape cartridge 100 according to the third embodiment, too, the cover detection section 52 is made to operate (turn ON) via the displacement portion 186. Therefore, not only the opening/closing of the open/close cover 7 can be detected but also the presence/absence of the tape cartridge 100 can be detected. Also, the input elastic portion 370 of the displacement portion 186 relatively presses the tape cartridge 100 and enables its positioning.

[Fourth Embodiment of Cover Detection]

Next, referring to FIG. 13, the structures of the protrusion to be detected 83 of the open/close cover 7 and the cover detection section 52 according to the fourth embodiment will be described in detail along with the structure of the displacement portion 186 of the tape cartridge 100. Also, in the fourth embodiment, different parts from the first embodiment will be mainly described.

Figure 13:
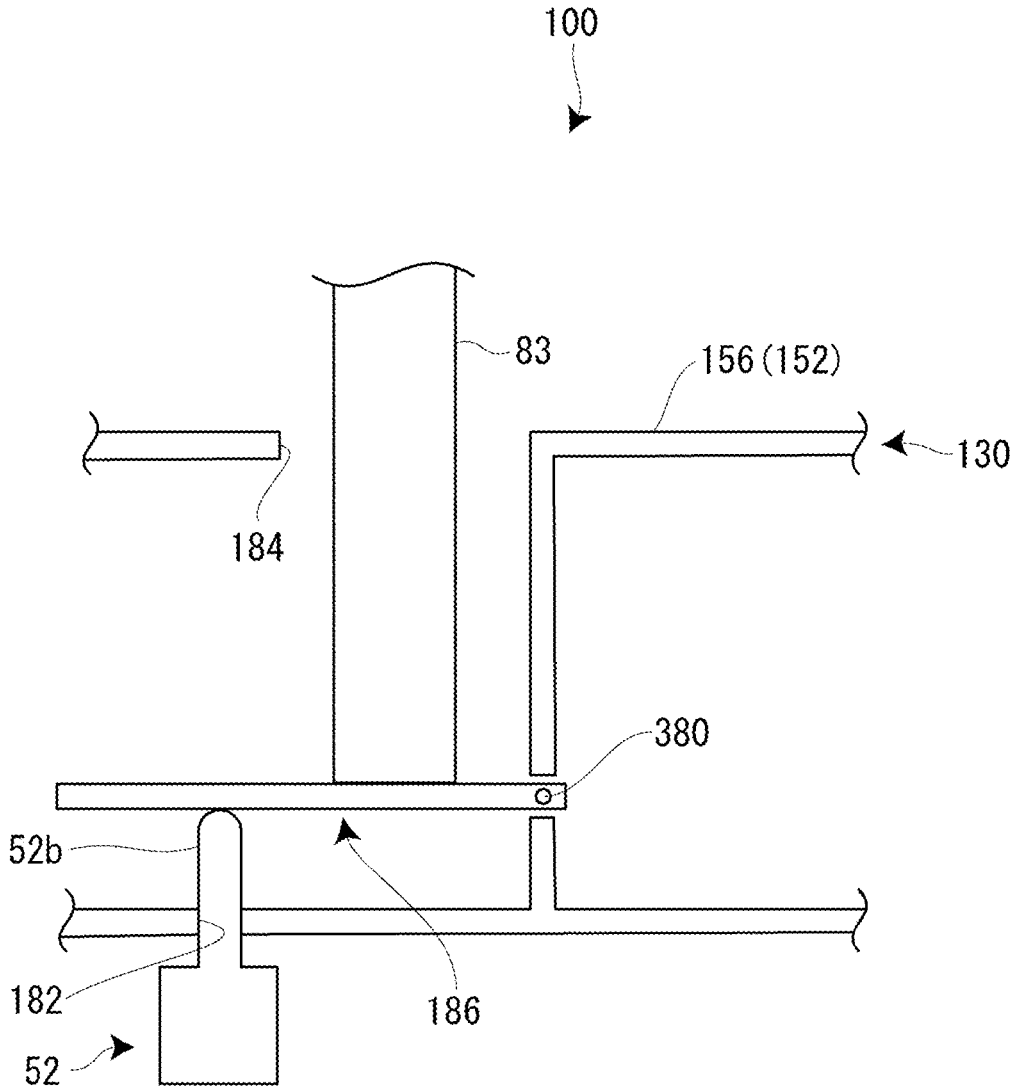
FIG. 13 is a cross-sectional view of the vicinities of a protrusion to be detected and a cover detection section according to a fourth embodiment.

As shown in FIG. 13, in the fourth embodiment, the displacement portion 186 is formed in the shape of a rectangular plate and supported in such a way as to be able to swivel on a swivel support portion 380 provided in the cartridge case 130. The protrusion to be detected 83 abuts against the top surface of the displacement portion 186, and the detector 52*b* abuts against the bottom surface. As the protrusion to be detected 83 presses the plate-like displacement portion 186, the displacement portion 186 swivels and presses the detector 52*b*.

In this way, in the fourth embodiment, too, the cover detection section 52 is made to operate (turn ON) via the displacement portion 186. Therefore, not only the opening/closing of the open/close cover 7 can be detected but also the presence/absence of the tape cartridge 100 can be detected. Also, in order to relatively press the tape cartridge 100 and enable its positioning, a torsion coil spring may be provided on the swivel axis of the displacement portion 186.

The invention claimed is:

1. A tape printing device comprising:

a cartridge loading section in which a tape cartridge is loaded in an unloadable manner;

an open/close cover which opens/closes the cartridge loading section;

a detection section which is provided in the cartridge loading section and detects closing of the open/close cover; and a section to be detected which is provided on the open/close cover, corresponding to the detection section;

wherein the section to be detected displaces a displacement portion of the tape cartridge loaded in the cartridge loading section, with the closing of the open/close cover, and the detection section is actuated for detection, with the displacement of the displacement portion.

2. The tape printing device according to claim 1, wherein the section to be detected has an element to be detected which is formed in a protruding manner integrally on a back side of the open/close cover and which displaces the displacement portion, and the element to be detected is formed in a protruding manner in a columnar shape with a "T"-shaped cross section.

3. The tape printing device according to claim 2, wherein the detection section includes a rod-like detector operated by the displacement of the displacement portion, and a detection section main body actuated for detection by the operated detector.

4. The tape printing device according to claim 3, wherein the displacement portion is arranged inside a cartridge case of the tape cartridge, and a first receiving opening for receiving the element to be detected and a second receiving opening for receiving the detector are formed in the cartridge case, the element to be detected displaces the displacement portion via the first receiving opening, and the detector is operated by the displacement portion via the second receiving opening.

5. The tape printing device according to claim 4, wherein the element to be detected is fitted in the first receiving opening, with the closing of the open/close cover.

6. The tape printing device according to claim 3, wherein with respect to the displacement portion, a position where the element to be detected abuts and a position where the detector abuts are shifted from each other, as viewed from a loading/unloading direction of the tape cartridge.

7. The tape printing device according to claim 2, wherein the displacement portion is formed in an elastically deformable manner, and the element to be detected elastically deforms the displacement portion with the closing of the open/close cover.

8. A tape printing system comprising:

the tape printing device according to claim 1; and the tape cartridge loaded in the cartridge loading section in an unloadable manner.

* * * * *